US011648700B2

(12) United States Patent
Paspatis et al.

(10) Patent No.: US 11,648,700 B2
(45) Date of Patent: May 16, 2023

(54) SKINCARE DEVICE HANDLE WITH FLEXIBLE PORTION

(71) Applicant: BIC VIOLEX S.A., Anoixi (GR)

(72) Inventors: Georgios Paspatis, Anoixi (GR); Anestis Tsegenidis, Anoixi (GR)

(73) Assignee: BIC Violex Single Member S.A., Anoixi (GR)

( * ) Notice: Subject to any disclaimer, the term of this patent is extended or adjusted under 35 U.S.C. 154(b) by 3 days.

(21) Appl. No.: 17/223,558

(22) Filed: Apr. 6, 2021

(65) Prior Publication Data

US 2021/0339415 A1 Nov. 4, 2021

(30) Foreign Application Priority Data

Apr. 30, 2020 (EP) ..... 20172267

(51) Int. Cl.
*B26B 21/52* (2006.01)

(52) U.S. Cl.
CPC ..... *B26B 21/52* (2013.01)

(58) Field of Classification Search
CPC ..... B26B 21/52; B26B 21/522; B26B 21/523
USPC ..... 30/526–535; D28/44–48; 15/167.1
See application file for complete search history.

(56) References Cited

U.S. PATENT DOCUMENTS 758,764 A * 5/1904 Yates ..... A46B 5/02 15/167.1
759,490 A * 5/1904 Macleod ..... A46B 5/02 15/167.1
1,423,414 A * 7/1922 Glaser ..... B26B 21/52 30/534
2,028,011 A * 1/1936 Raymond ..... B26B 21/52 30/526
2,053,258 A * 9/1936 Axien ..... B26B 21/52 30/534
2,083,172 A * 6/1937 Smith ..... B26B 21/52 30/526
2,229,666 A * 1/1941 Monnet ..... B26B 21/52 30/526
2,600,318 A * 6/1952 Patrignani ..... B26B 21/16 30/527
2,980,457 A * 4/1961 Page ..... B25G 1/02 30/340

(Continued)

FOREIGN PATENT DOCUMENTS

EP 3372359 A1 9/2018
EP 3388211 A1 10/2018

(Continued)

OTHER PUBLICATIONS

Extended European search report issued in European Patent Application No. 20172267.5, dated Oct. 1, 2020.

(Continued)

*Primary Examiner* — Jason Daniel Prone
(74) *Attorney, Agent, or Firm* — Bookoff McAndrews, PLLC

(57) ABSTRACT

A handle for a shaver including a manipulation portion, a connection portion that connects to a razor cartridge, and a first flexible portion connecting the manipulation portion to the connection portion, the first flexible portion including a plurality of deformation cells of one or more predetermined shapes between the manipulation and connection portions.

20 Claims, 4 Drawing Sheets

(56) References Cited

U.S. PATENT DOCUMENTS 3,317,995 A * 5/1967 Bord ..... B26B 21/24 30/527
3,823,471 A * 7/1974 Stone ..... B26B 21/06 30/526
4,879,811 A * 11/1989 Cooney ..... B26B 21/52 30/527
4,955,136 A * 9/1990 Diaz-Rivera ..... B26B 21/522 30/527
5,038,472 A 8/1991 Iderosa
5,046,249 A * 9/1991 Kawara ..... B26B 21/38 30/44
5,054,154 A * 10/1991 Schiffer ..... A46B 5/02 15/167.1
5,070,614 A * 12/1991 Hardin ..... B26B 21/521 30/527
5,351,358 A * 10/1994 Larrimore ..... A46B 5/02 15/167.2
5,560,106 A 10/1996 Armbruster et al.
5,600,887 A * 2/1997 Olson ..... B26B 21/528 30/527
5,678,316 A * 10/1997 Althaus ..... B26B 21/522 30/527
5,735,012 A * 4/1998 Heinzelman ..... A46B 5/002 15/167.1
5,771,591 A 6/1998 Armbruster et al.
6,003,189 A * 12/1999 Falleiros ..... A46B 5/0062 15/167.1
6,266,888 B1 * 7/2001 Zowaski ..... B26B 21/523 30/526
6,473,971 B2 * 11/2002 Ordaz ..... B26B 21/08 30/527
6,886,262 B2 * 5/2005 Ohtsubo ..... B26B 21/522 30/526
6,973,730 B2 * 12/2005 Tomassetti ..... B26B 21/225 30/527
6,990,706 B2 * 1/2006 Broecker ..... A46B 5/0062 15/167.1
7,086,116 B2 * 8/2006 Broecker ..... A46B 5/0062 15/167.1
D619,763 S 7/2010 Coresh
7,934,320 B2 * 5/2011 Gratsias ..... B26B 21/522 30/527
8,366,179 B2 * 2/2013 Houser ..... B62K 25/04 296/180.1
8,640,342 B2 * 2/2014 Murgida ..... B26B 21/522 30/527
8,763,196 B2 * 7/2014 Kraemer ..... A46B 5/0066 15/167.1
8,833,486 B2 * 9/2014 Krauter ..... B25F 5/006 173/162.1
9,592,614 B2 * 3/2017 Oosterhoff ..... B26B 19/146
9,731,424 B1 * 8/2017 Holmes ..... B26B 19/046
10,405,903 B1 * 9/2019 Biesinger ..... A61B 17/864
10,638,829 B1 * 5/2020 Haverman ..... A46B 5/02
10,906,195 B2 * 2/2021 Bady ..... B26B 19/145
11,148,310 B2 * 10/2021 Maimone ..... B26B 21/523
11,413,777 B2 * 8/2022 Brellis ..... B26B 21/522
2002/0083600 A1 * 7/2002 Donovan ..... B26B 21/52 30/526
2004/0177518 A1 * 9/2004 Leventhal ..... B26B 21/52 30/526
2006/0090277 A1 * 5/2006 Petit ..... A46B 5/02 15/144.1
2006/0117509 A1 * 6/2006 Mason ..... A46B 5/02 15/143.1
2007/0208354 A1 * 9/2007 Barraclough ..... A45D 27/44 606/133
2008/0163500 A1 7/2008 Bozikis et al.
2010/0287784 A1 * 11/2010 Qiu ..... B26B 19/3853 30/527
2013/0298407 A1 * 11/2013 Ramirez ..... B26B 21/52 30/50
2014/0123506 A1 * 5/2014 Gaines ..... B26B 21/52 30/526
2016/0029859 A1 * 2/2016 Harrington ..... A46B 5/02 15/143.1
2016/0151925 A1 * 6/2016 Gers-Barlag ..... B26B 21/522 30/526
2018/0257249 A1 9/2018 Wattam et al.
2021/0274924 A1 * 9/2021 Zhang ..... A46B 5/02
2022/0015530 A1 * 1/2022 Hachisuka ..... A46B 5/02

FOREIGN PATENT DOCUMENTS

GB 543801 A 3/1942
WO 2013048830 A1 4/2013
WO 2016020009 A1 2/2016

OTHER PUBLICATIONS

Bulent Yusuf, Metamaterial Mechanisms: 3D Printed Door Handle & No Moving Parts, retrieved from the Internet at https://all3dp.com/metamaterial-mechanisms/ on Mar. 31, 2021, 6 pages.

* cited by examiner

SKINCARE DEVICE HANDLE WITH FLEXIBLE PORTION

CROSS-REFERENCE TO RELATED APPLICATION(S)

This application claims benefit from European patent application 20172267.5, filed on 30 Apr. 2020, its content being incorporated herein by reference.

FIELD

The present disclosure relates to the field of skincare devices, for example shavers, and handles therefor.

BACKGROUND

Cartridge shavers are known to be provided with mobility between the shaver's head (or cartridge) and handle using one or more spring-loaded hinges, so as to facilitate contact between the head and skin. An example is International Patent Application WO2016020009 which discloses a razor handle comprising an elongated body extending in a longitudinal direction, the elongated body having an outer surface and being provided with a first hole opening on the outer surface, the razor handle further comprising an element provided within the first hole, the element being integral with the elongated body and having a shape that is different from the shape of the first hole. Further, connecting means are disclosed which are integral with the elongated body that comprises two flexible arms extending from the elongated body and protruding toward a free end at the front end of the razor handle. Each arm further has on its upper face a plurality of small cavities. However, conventional techniques for enabling mobility of a head with respect to a handle of a skincare device greatly increase skincare device complexity and cost. Therefore, a need exists to avoid such a complexity and costs.

SUMMARY

According to examples of the present disclosure, a handle may be provided, which is suitable for a shaver. The handle includes a manipulation portion, a connection portion configured to connect to a razor cartridge, and a first flexible portion connecting the manipulation portion to the connection portion. The first flexible portion includes one or more deformation cells of one or more predetermined shapes between the manipulation portion and connection portion.

Such a handle may allow the connection portion to move relative to the manipulation portion, in directions and/or ranges that are based on the deformation cells.

The first flexible portion may include a longitudinal tubular portion, including a cavity delimited by an upper wall, a lower wall, and two lateral walls. The upper wall may be opposite to the lower wall, the two lateral walls may be opposite to each other, and connect the upper and the lower walls together. The upper and lower sides may be on opposite sides with regard to a shaving direction.

A longitudinal tubular portion may be a tubular portion having an axis, the axis extending along a longitudinal direction/axis of the handle.

The shaving direction may be a direction, substantially perpendicular to the longitudinal direction of the handle, along which the razor is moved in order to shave.

The upper wall may be disposed on an upper side of the handle, while the lower wall may be disposed on a lower side of the handle.

The one or more deformation cells are arranged as one or more first deformation cells included on the upper wall. Additionally or alternatively, the one or more deformation cells are arranged as one or more second deformation cells included on the lower wall.

At least one first deformation cell may include a through hole extending transversely through the upper wall.

At least one second deformation cell may include a blind hole opening within the cavity.

The first deformation cells and/or the second deformation cells may have a quadrilateral cross section.

The axes of the holes of the first and/or second deformation cells may be substantially parallel to the shaving direction.

The number of first deformation cells may be equal to the number of second deformation cells.

The first deformation cells may be coaxial with the second deformation cells.

The tubular portion may include a transverse interior wall connecting at least the upper and the lower walls to each other.

The interior wall may divide the cavity into two or more third deformation cells which extend transversely to a longitudinal axis of the handle, between the lateral walls of the tubular portion.

The first flexible portion may include at least two first and/or two second deformation cells offset in opposite directions from each other with respect to the interior wall.

The connection portion and/or the manipulation portion may be made of a first material, and the first flexible portion may include a second material, different from the first material. The first material may include an ABS-like photopolymer resin. The second material may include a rubber-like photopolymer resin.

The second material may be more elastic than the first material.

The handle may include a release portion including at least a second flexible portion arranged between the first flexible portion and an attachment point of the connection portion for attachment of the razor cartridge to the connection portion.

The connection portion may be detachable from the razor cartridge by deflecting the at least a second flexible portion away from a rest position of the at least a second flexible portion.

The second flexible portion may include a living hinge connecting the attachment point to the first flexible portion.

The second flexible portion may include an elastomeric element configured to bias the living hinge of the second flexible portion towards the rest position.

A living hinge is a region of material joining two other regions of the same material, which is both thinner and more flexible than the regions it joins.

A distance between hole axes of neighboring deformation cells may be between 3.5 and 5.5 mm (millimeters), inclusive.

The first flexible portion may be configured to allow a bending movement of the connection portion relative to the manipulation portion about a first axis, and also a torsional movement of the connection portion relative to the manipulation portion about a second axis perpendicular to the first axis.

The second axis may be parallel to a longitudinal axis of the manipulation portion.

Additionally or alternatively, a skincare device may be provided, including a handle as described earlier herein. The skincare device may include a razor cartridge configured to be removably or fixedly attached to the handle.

Additionally or alternatively, a process of manufacturing a handle according as described earlier herein may be provided. The process includes providing the manipulation and connection portions, and fabricating the first flexible portion. The step of fabricating the first flexible portion includes additively-manufacturing at least the first flexible portion.

BRIEF DESCRIPTION OF THE DRAWINGS

The disclosure may be more completely understood in consideration of the following detailed description of aspects of the disclosure in connection with the accompanying drawings, in which.

Figure 1:
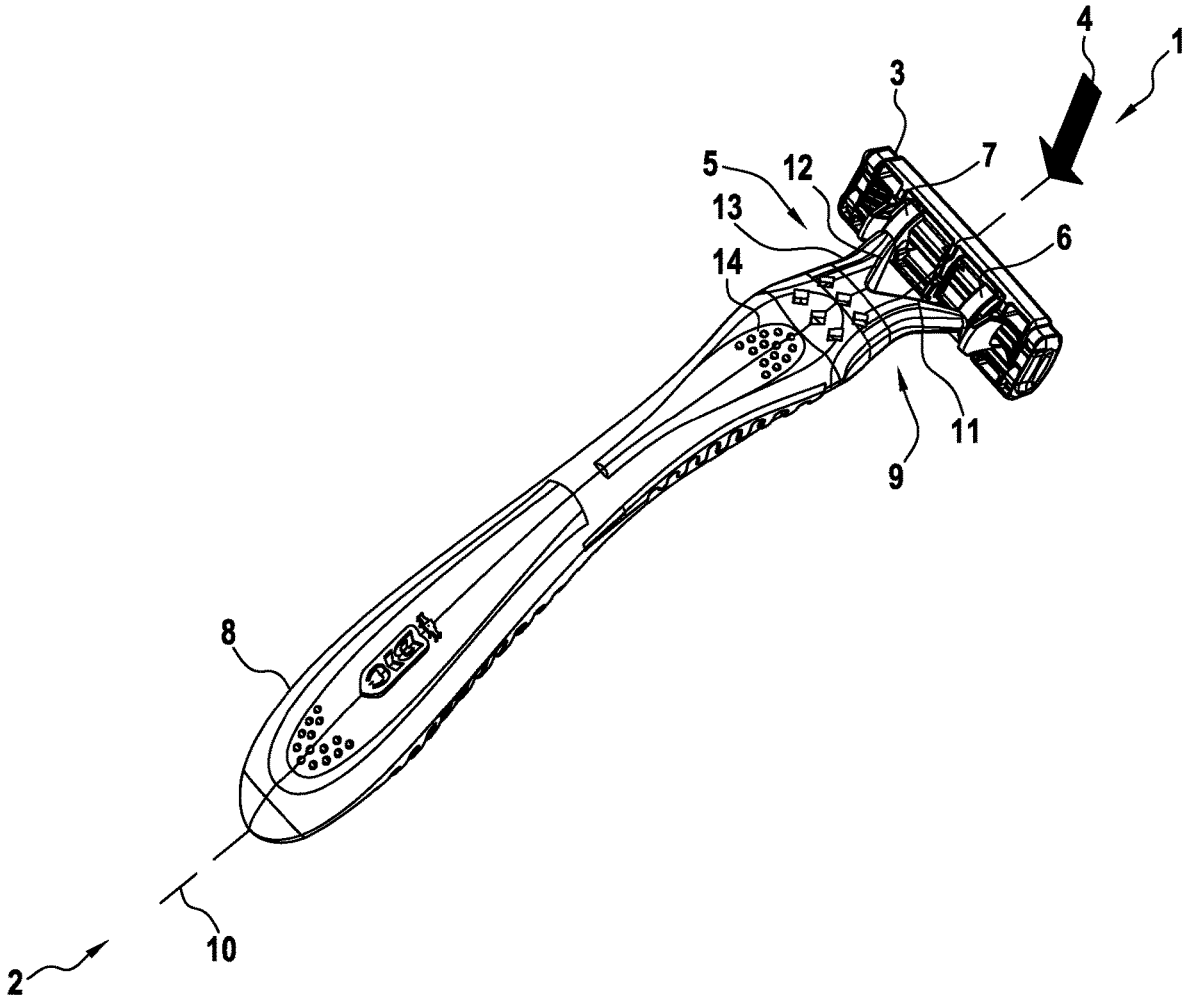
FIG. 1 shows an exemplary skincare device.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the disclosure. The illustrative aspects depicted are intended only as exemplary.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like fashion (for example, "between" versus "directly between," "adjacent" versus "directly adjacent," etc.).

Although the terms "first," "second," etc. may be used herein to describe various elements, components, regions, layers, sections, and/or parameters, these elements, components, regions, layers, sections, and/or parameters should not be limited by these terms. These terms are only used to distinguish one element, component, region, layer, or section from another region, layer, or section. Thus, a first element, component, region, layer, or section discussed herein could be termed a second element, component, region, layer, or section without departing from the teachings of the present disclosure.

FIG. 1 shows an exemplary skincare device 1—in this case an exemplary disposable shaver. The shaver includes an upper side which is arranged towards the viewer, and a lower side which is arranged away from the viewer. The shaver includes a handle 2 permanently connected to a head 3. The head 3 is provided as a cartridge housing one or more blades. In a conventional manner, during shaving, when the cartridge is maneuvered in a shaving direction 4 while in contact with skin, the blade(s) may cause hair growing from the skin to be cut.

The handle 2 includes a connection portion 5, including at least one—in this case two—attachment points 6, 7 for directly connecting to the head 3. During shaving, the head 3 is arranged between the attachment points 6, 7 and the skin being shaved. The attachment points 6, 7 may rigidly or pivotably connect the head 3 to the handle 2.

The handle 2 includes a manipulation portion 8 which is connected to the connection portion 5 by way of a first flexible portion 9. The manipulation portion 8, first flexible portion 9, and connection portion 5 of the handle 2 are arranged along a longitudinal axis 10 of the handle, with the first flexible portion on the longitudinal axis between the manipulation and connection portions.

Each attachment point 6, 7 is mounted on the end of an arm 11, 12 extending from the first flexible portion 9. The two attachment points' arms 11, 12 are jointed together at a common trunk 13 which is attached to the first flexible portion 9.

The manipulation portion 8 may include one or more fingertip placement features 14, such as indentations, for a user to place his/her fingertip(s) during shaving. In this way, the user may be dissuaded from gripping the first flexible portion 9.

The first flexible portion 9 is directly connected to the manipulation portion 8 and directly connected to the connection portion 5. The first flexible portion 9 allows a bending movement of the connection portion 5 relative to the manipulation portion 8 in the shaving direction 4, and also a torsional movement of the connection portion 5 relative to the manipulation portion 8 about the longitudinal axis 10.

The manipulation 8 and connection portions 5 are made of a relatively rigid material, for example an ABS-like photopolymer resin or a polypropylene-like photopolymer resin. Digital ABS, available from Stratasys, is a non-limiting example of an ABS-like photopolymer resin. Durus (such as Durus White) and Rigur, available from Stratasys, are non-limiting examples of polypropylene-like photopolymer resins. The first flexible portion 9 is made of a relatively flexible material, such as a rubber-like photopolymer resin. The rubber-like photopolymer resin may have a shore hardness of 40-85, or even 60 for example. Tango and Agilus30, available from Stratasys, are non-limiting examples of rubber-like photopolymer resins. Forces applied to the handle 2 during shaving may deform the first flexible portion 9 more than the manipulation 8 and connection 5 portions. The material of the first flexible portion 9 may additionally be relatively resilient compared to the material of the manipulation 8 and/or connection 5 portions.

The first flexible portion 9 includes one or more deformation cells, which may favor deformation of the first flexible portion during shaving in response to shaving forces. The deformation cells are arranged between the manipulation 8 and connection 5 portions.

Figure 2:
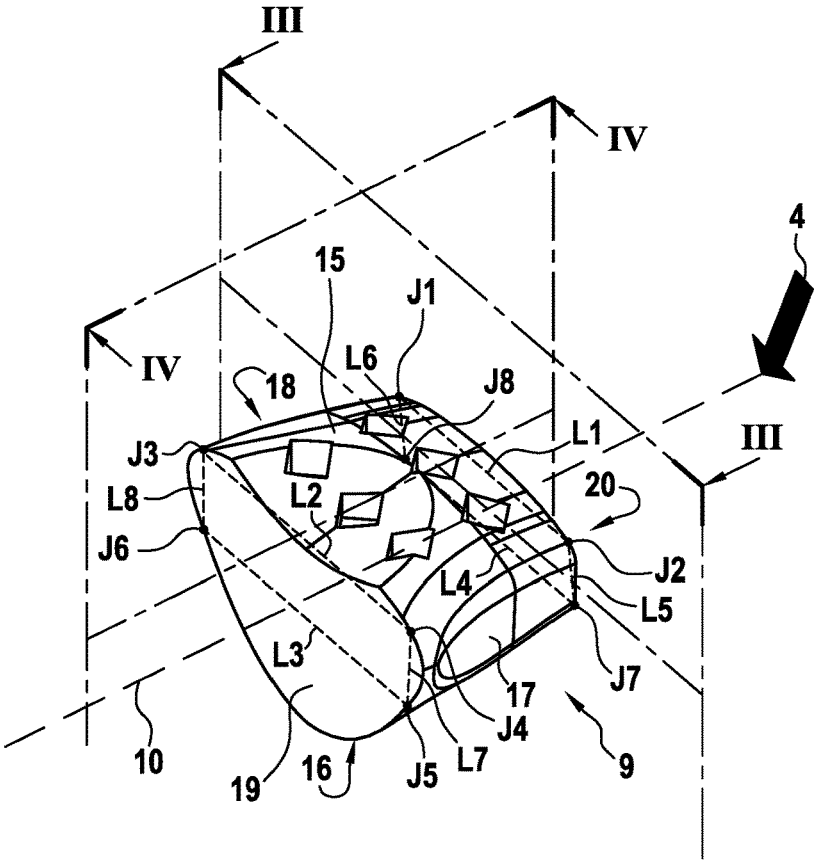
FIG. 2 shows an exemplary first flexible portion visible in FIG. 1.

FIG. 2 shows the first flexible portion 9 visible in FIG. 1. The first flexible portion 9 includes a tubular portion arranged to extend substantially along the longitudinal axis 10 of the handle. The tubular portion includes an upper wall 15 which is disposed on an upper side of the handle, and a lower wall 16 which is disposed on a lower side of the handle. The upper and lower sides of the handle are on opposite sides of the handle with regard to the shaving direction 4.

The tubular portion includes two lateral walls 17, 18 which connect the upper and lower walls together.

The tubular portion may additionally include an axial wall 19 arranged towards the manipulation portion and configured to be directly connected thereto, and/or an axial wall 20 arranged towards the connection portion and configured to be directly connected thereto.

Figure 3:
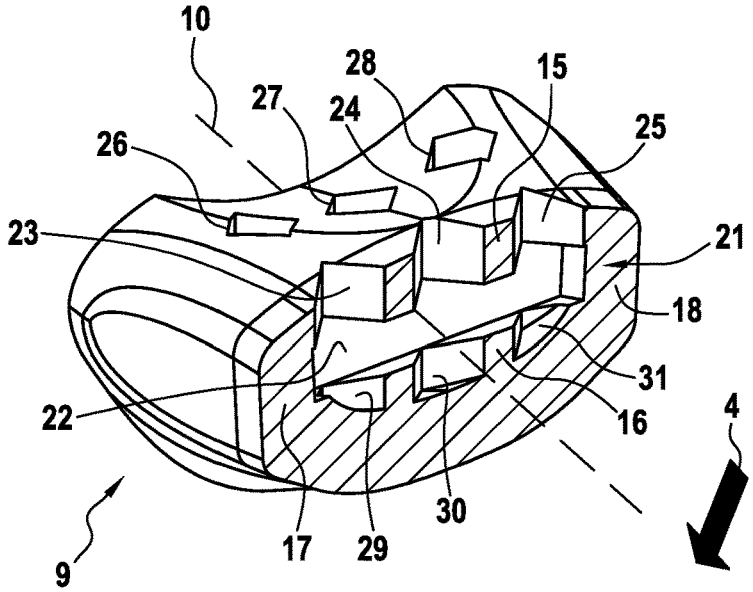
FIG. 3 shows the first flexible portion of FIG. 2 along cut plane III-III.

FIG. 3 shows the first flexible portion 9 of FIG. 2, cut along plane III-III. The tubular portion includes a cavity 21 delimited by the upper 15 and lower 16 walls, and by the two lateral walls 17, 18.

The upper 15 and lower 16 walls are on opposite sides of the cavity 21 from one another. The upper 15 and lower 16 walls extend between the lateral walls 17, 18 in a direction that is substantially perpendicular to the shaving direction 4. For example, a point 31 of the junction between the upper wall 15 and the left lateral wall 18 which is closest to the connection portion, and a point J2 of the junction between the upper wall 15 and the right lateral wall 17 which is closest to the connection portion may define a line L1 which is at an angle of more than 45° (degrees) and less than 135° with respect to the shaving direction. The same may be true with regard to a line L2 defined by a point J3 of the junction between the upper wall 15 and the left lateral wall 18 which is closest to the manipulation portion, and a point J4 of the junction between the upper wall 15 and right lateral wall 18 which is closest to the manipulation portion. For example, the same may also be true for a line L3 defined by a point J5 of the junction between the lower wall 16 and the right lateral walls 17 which is closest to the manipulation portion, and a point J6 of the junction between the lower wall 16 and the left lateral wall 18 which is closest to the manipulation portion. The same may also be true for a line L4 defined by a point J7 of the junction between the lower wall 16 and the right lateral wall 17 which is closest to the connection portion, and a point J8 of the junction between the lower wall 16 and the left lateral wall 18 which is closest to the connection portion.

The two lateral walls 17, 18 are on opposite sides of the cavity 21 from one another. The lateral walls 17, 18 extend from the upper wall 15 to the lower wall 16 in a direction that is substantially parallel to the shaving direction 4. For example, points J2 and J7 may define a line L5 which is at an angle of more than 135° and less than 45° with respect to the shaving direction. The same may be true for a line L6 defined by points J1 and J8. For example, the same may also be true for a line L7 defined by points J4 and J5. The same may be true for a line L8 defined by points J3 and J6.

The tubular portion may include an interior wall 22 which is arranged transverse to the longitudinal axis 10 of the handle, and intermediate surfaces (axial wall 19 and axial wall 20) of the first flexible portion 9 which are directly connected to the manipulation and connection portions, respectively. The interior wall 22 connects at least the upper 15 and lower 16 walls (or in this case the upper and lower walls, and both lateral walls 17, 18) of the tubular portion to each other. The interior wall 22 may limit or even prevent collapse of opposing walls (for example the upper 15 and lower 16 walls) of tubular portion towards each other during deformation of the first flexible portion 9.

The one or more deformation cells may include one or more first deformation cells arranged in the upper wall 15. Each first deformation cell 23-28 may be provided as a through hole extending transversely through the upper wall 15. In the example illustrated here, six first deformation cells are provided, of which three —23, 24, 25—are shown in section and form a first row of first deformation cells, and three —26, 27, 28—are shown in their entirety and form a second row of first deformation cells.

When multiple rows are provided, the rows are arranged in series along the longitudinal axis 10. The multiple rows may be provided at intervals of 3.5-5.5 mm (millimeters) for example. In the example illustrated here, the first and second rows are provided at an interval of 4.5 mm along the longitudinal axis 10. When three or more rows are present, the rows may be provided at regular or varying intervals along the longitudinal axis 10.

The row of first deformation cells nearest to the connection portion may be provided at a distance therefrom of 2.3-3.5 mm as measured along the longitudinal axis. In the example illustrated here, the first row of first deformation cells is arranged at a distance of 2.90 mm from the connection portion, as measured along the longitudinal axis.

The row of first deformation cells nearest to the manipulation portion may be provided at a distance therefrom of 2.5-3.8 mm as measured along the longitudinal axis. In the example illustrated here, the second row of first deformation cells is arranged at a distance of 3.20 mm from the manipulation portion, as measured along the longitudinal axis.

Although the example illustrated here includes two rows of first deformation cells, it is contemplated to provide as few as one row containing one or more first deformation cells, or as many as five or more rows containing one or more first deformation cells. When two or more rows of first deformation cells are provided, the number of first deformation cells the rows may be identical to or different from each other.

Although each row is shown as having three first deformation cells arranged in series from one to the other of the lateral walls 17, 18, it is also contemplated for a given row to contain as few as one first deformation cell extending from one to the other of the lateral walls 17, 18. When a given row includes multiple first deformation cells, the row's first deformation cells may be arranged in series from one of the lateral walls 17, 18 to the other. The row's first deformation cells may be provided at intervals of 3.2-4.8 mm for example. When a given row includes three or more first deformation cells, the cells may be provided at regular or varying intervals. In the example illustrated here, each row's corresponding deformation cells are provided at intervals of 4.00 mm in series from the left lateral wall 18 to the right lateral wall 17.

When the interior wall 22 is present, at least two of the first deformation cells 23-28 may be offset from the interior wall in opposite directions from each other. For example, the three first deformation cells 23-25 shown in section are offset to be intermediate the interior wall 22 and the connection portion when the first flexible portion 9 is directly connected thereto, whereas the three first deformation cells 26-28 shown in their entirety are offset to be intermediate the interior wall 22 and the manipulation portion when the first flexible portion 9 is directly connected thereto.

The one or more deformation cells may also include one or more second deformation cells provided in the lower wall 16. Each second deformation cell may be provided as a blind hole in the lower wall 16 which opens towards and into the cavity 21. Use of blind holes in the lower wall 16 may increase the life of the first flexible portion 9, compared to through holes.

For example, three second deformation cells —29, 30, 31—are shown in section, which are coaxial to the three first deformation cells shown in section 23-25.

Figure 4:
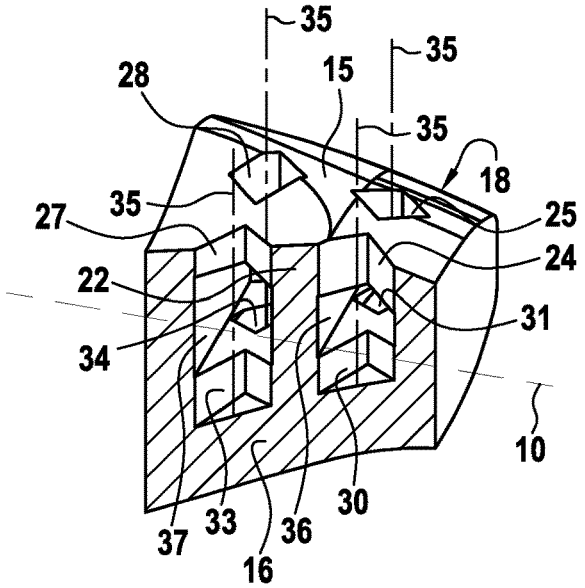
FIG. 4 shows the first flexible portion of FIG. 2 along cut plane IV-IV.

FIG. 4 shows the first flexible portion 9 of FIG. 2 along cut plane IV-IV. The number of second deformation cells 30, 31, 33, 34 may be equivalent to the number of first deformation cells 24, 25, 27, 28. When the interior wall 22 is present, at least two of the second deformation cells 30, 31, 33, 34 may be offset from the interior wall in opposite directions from each other.

The deformation cells have predetermined shapes, which may help to authorize one or more predetermined movements of the connection portion with respect to the manipulation portion. For example, the deformation cells may authorize the bending described above, and possibly also torsion of the connection portion with respect to the manipulation portion about an axis extending from the manipulation portion towards the head (for example the longitudinal axis 10).

For example, the first and second deformation cells are shown as having substantially quadrilateral cross-sections with respect to their respective holes' axes 35. In the example illustrated here, the cross-section is delimited by an equilateral quadrilateral with a side length of 2.00 mm as measured within the plane of the cross-section, though side lengths of 1.6-2.4 mm are also contemplated. Other polygonal cross-sections are also contemplated, including triangular or hexagonal cross-sections. Non-polygonal forms are also contemplated, including circular, oval and elliptical cross-sections, or even cross-sections composed delimited by combinations of at least one curve and at least one line-segment.

The axes 35 of the holes of the first and second deformation cells are arranged substantially parallel to the shaving direction 4. For example, each axis may be arranged at an angle of less than 45° and more than 135° with respect to the shaving direction. The first and second deformation cells' holes' axes 35 may be arranged to extend between the upper 15 and lower 16 walls of the tubular portion. The first (and when present second) deformation cells guide the aforementioned bending of the connection portion 5 relative to the manipulation portion 8.

The interior wall 22, when present, divides the cavity into two third deformation cells 36, 37 which extend transversally to the longitudinal axis 10 of the handle, between the lateral walls of the tubular portion. The third deformation cells 36, 37 may be concealed between the upper wall, lower wall, and lateral walls of the tubular portion. The third deformation cells 36, 37 guide the aforementioned torsion of the connection portion 5 relative to the manipulation portion 8. It is also contemplated to provide multiple interior walls, so as to divide the cavity into three or more third deformation cells. The third deformation cells 36, 37 may additionally contribute to guiding the aforementioned bending.

Each third deformation cell 36, 37 may extend 2.3-3.5 mm along the longitudinal axis. Although, in the example illustrated here, the third deformation cell 37 nearest to the manipulation portion extends 2.83 mm along the longitudinal axis, as does the third deformation cell 36 nearest to the connection portion, it is also contemplated for any two third deformation cells to extend different by amounts along the longitudinal axis.

The cavity may have a height at its nearest extent to the manipulation portion, as measured from the upper wall 15 to the lower wall 16 of 3.3-4.9 mm, for example 4.11 mm. The cavity may have a height at its nearest extent to the connection portion of 1.0-1.6 mm, for example 1.33 mm. The third deformation cell 37 nearest the manipulation portion may have a height, as measured from the upper wall 15 to the lower wall 16, at its nearest extent to the connection portion, of 2.5-3.7 mm, for example 3.15 mm. The third deformation cell 36 nearest the connection portion may have a height at its nearest extent to the manipulation portion of 2.0-3.0 mm, for example 2.51 mm.

The interior wall(s) 22 may be arranged at regular intervals along the longitudinal axis between the between the manipulation portion and the connection portion. In the example illustrated here, the interior wall 22 is halfway between the manipulation and connection portions, as measured along the longitudinal axis.

All of the herein disclosed ranges of parameters for the arrangement of deformation cells within the first flexible portion 9 may be suitable for conferring mobility thereto in bending and/or in torsion. The example illustrated here further provides for enhanced behavior in terms of restoration of the first flexible portion from a deflected position to a rest position when the head of the skincare device is removed from contact with skin.

Figure 5:
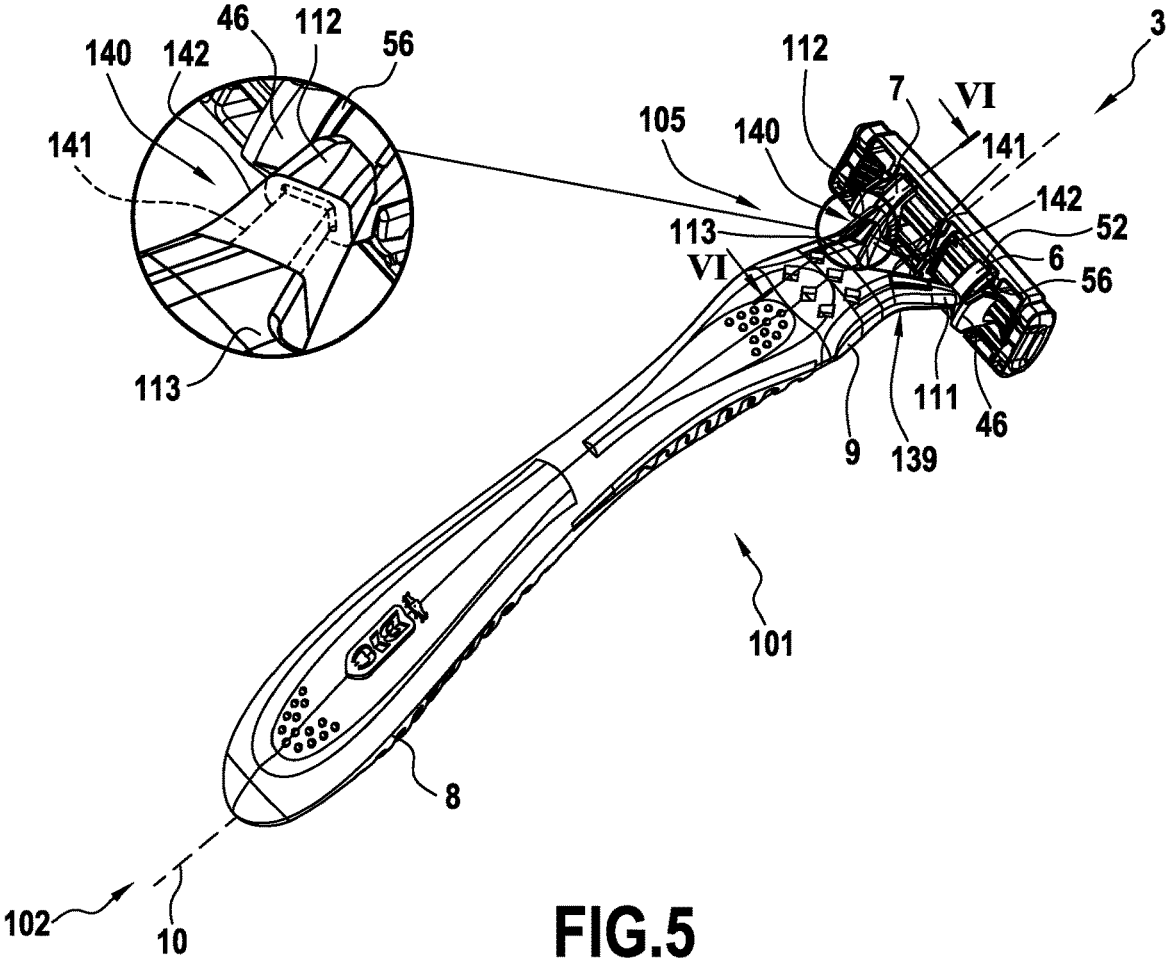
FIG. 5 shows an exemplary variant of the skincare device of FIG. 1.

FIG. 5 shows an exemplary skincare device 101—in this case an exemplary a refillable variant of the skincare device 1 shown in FIG. 1. Because it is refillable, the variant shown in FIG. 5 includes a handle 102 and a head 103 which are detachable from one another, such that the head may be replaced while conserving the handle. Reference numerals common to the variant illustrated in FIG. 5 and the variant illustrated in FIG. 1-4 designate identical features.

As with the handle 2 seen in FIG. 1, the handle 102 seen in FIG. 5 includes a manipulation portion 8, at least a first flexible portion 9, and a connection portion 105. The manipulation portion 8 and first flexible portion 9 are identical to those discussed earlier herein.

The connection portion 105 includes two attachment points 6, 7 mounted on arms 111, 112 extending from a common trunk 113. The trunk 113 is directly connected to the first flexible portion 9.

A release portion is provided intermediate the first flexible portion 9 and at least one of the attachment points 106, 107. A user may move the release portion to detach the head 103 from the handle 102.

The release portion includes at least a second flexible portion 139, 140 arranged on a first of the two arms 111. The second flexible portion 139 authorizes lateral movement of the attachment point 6 of the first arm 111 with respect to the attachment point 7 of the second of the two arms 112. As seen here, the second arm 112 may also be provided with its own second flexible portion 140.

Deflecting the second flexible portion(s) 139, 140 away from its/their rest position(s) may authorize or cause detachment of the head 3 from the attachment point(s) 6, 7.

Each second flexible portion 139, 140 includes a living hinge 141 provided in the arm 111, 112. The living hinge 141 is provided between the trunk 113 and the attachment point 6, 7, such that the attachment point is connected to the trunk via the living hinge of the second flexible portion. Each living hinge 141 is an elastically deformable neck of its corresponding arm 111, 112.

The second flexible portion 139, 140 includes an elastomeric element 142, which may be configured to bias the living hinge 141 towards its rest position. In the rest position, the attachment points 6, 7 are positioned relative to each other such that the head 3 may be retained to the handle 102. The elastomeric element 142 may be provided with a different color from the remainder of its respective second flexible portion 139, 140 serve as a visual indicator to a user of where deflection of the second flexible portion 139, 140 is to occur, and/or may provide a region presenting relatively higher friction on the user's fingertip, with respect to the remainder of the second flexible portion 139, 140, to facilitate application of deflecting forces.

The living hinge 141 may return to its rest position when a user no longer applies forces to deflect the second flexible portion 139, 140.

The elastomeric element 142 may be provided as an elastomeric layer on the living hinge 141. The elastomeric layer may even be arranged on all sides of the living hinge 141, for example to apply restoring forces along multiple axes.

As a non-limiting example, the elastomeric element 142 may be made of the same material as the first flexible portion 9.

The elastomeric element 142 may be provided with a different color than the trunk 113 and/or attachment point 106, 107, to serve as a visual indicator to a user of where the arm 111, 112 will bend during deflection.

The handles 2, 102 as described earlier herein may be manufactured by providing the manipulation portion 8 and connection portion 5, 105, and by additively-manufacturing the first flexible portion 9, for example by 3D-printing. As a non-limiting example, the manipulation portion 8 and/or the connection portion 5, 105 may be provided using conventional manufacturing techniques, such as molding. Alternatively, a non-limiting example, the manipulation portion 8 and/or connection portion 5, 105 may also be provided through additive manufacturing, possibly concurrently with the first flexible portion 9. When the handle 2, 102 includes a second flexible portion 139, 140, the elastomeric element 142 thereof may also be provided through additive manufacturing, possibly concurrently with fabrication of the first flexible portion 9. "Additive manufacturing" is understood to include joining materials to make objects from three-dimensional model data, typically through application of multiple layers of one or more materials upon each other. Non-limiting examples of additive manufacturing include 3D Printing, stereolithography, and the like.

Figure 6:
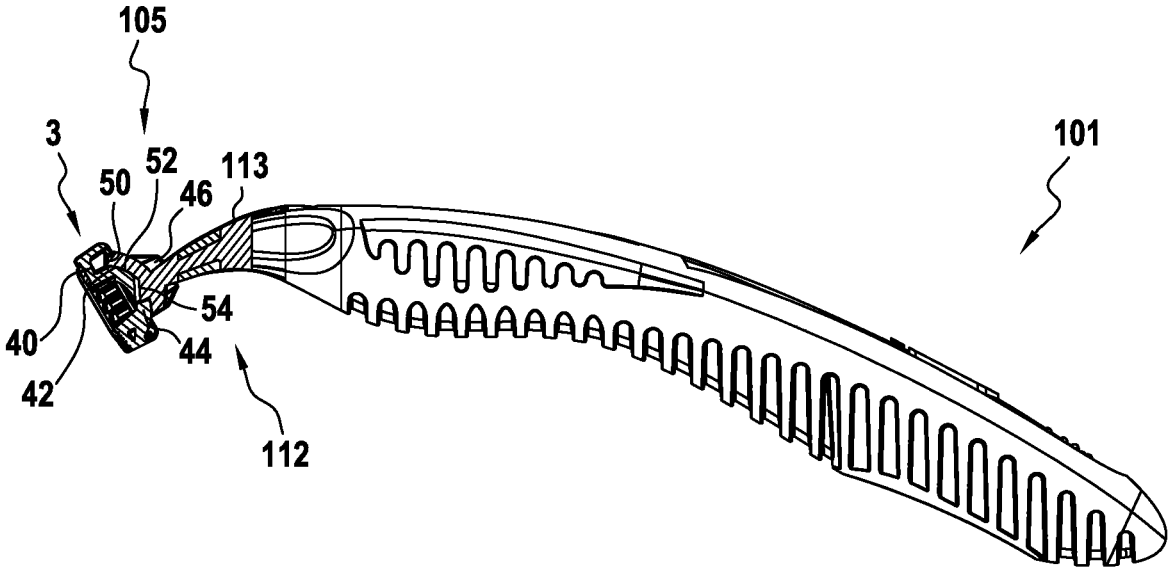
FIG. 6 shows a sectional view of the skincare device of FIG. 5.

FIG. 6 shows a sectional view of the second arm 112 of the connection portion 105 visible in FIG. 5. The second arm 112 terminates, at an extremity opposite from the manipulation portion 8 in an attachment point 7 configured to cooperate with the head 3. The head 3 includes a cylindrical (and in this case convex) guide surface 42 terminating in a slot 40 on the upper side of the skincare device 101. The slot 40 includes a surface arranged to extend radially away from and parallel to the cylindrical axis of the guide surface 42.

The attachment point 7 includes a slider 50 configured to penetrate in the slot 40, with a corresponding cylindrical (and in this case concave) contact surface 52 configured to contact the guide surface 42 slidingly. Abutment of the slot 40 and slider 50 limits pivoting of the head 3 with respect to the connection portion 105.

The slider 50 terminates in a protrusion 54 on the lower side of the skincare device 101 extending radially towards the cylindrical axis of the contact surface 52. The head 3 includes a corresponding stopper 44 arranged on the lower side of the skincare device 101. Abutment of the protrusion 54 and stopper 44 limits pivoting of the head 3 with respect to the connection portion 105.

To retain the guide surface 42 and contact surface 52 to one another, the head 3 includes a hook-shaped retainer 46 configured to extend radially with respect to the cylindrical axis of the guide surface 42 towards the connection portion 105, beyond the contact surface 52.

Returning now to FIG. 5, it can be seen that the attachment point 7 includes a corresponding rail 56 presenting a cylindrical surface on which the retainer may rest slidingly. Such cooperation between the head 3 and connection portion 105 may also be seen with regard to the first arm 111, where analogous features are provided.

The rail 56 may be substantially flat in a direction parallel to its cylindrical axis. As an arm 111, 112 is moved perpendicular to the longitudinal axis 10 during deflection of its corresponding second flexible portion 139, 140, the arm's attachment point 6, 7 slides substantially parallel to the cylindrical axis of its corresponding rail 56 until it is no longer in contact with its corresponding retainer 46. The head 3 is thus released from the attachment point 6, 7.

Although the described embodiments were provided as different exemplary embodiments, it is envisioned that these embodiments are combinable or, when not conflicting, the features recited in the described embodiments may be interchangeable. Moreover, the features recited in the described embodiments are not inextricably linked to one another, unless such a linkage is clearly indicated between two given features.

Throughout the description, including the claims, the term "comprising a" should be understood as being synonymous with "comprising at least one" unless otherwise stated. In addition, any range set forth herein, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A handle for a shaver comprising a manipulation portion, a connection portion configured to connect to a razor cartridge, and a first flexible portion connecting the manipulation portion to the connection portion, the first flexible portion including one or more deformation cells of one or more predetermined shapes between the manipulation portion and the connection portion, wherein the one or more deformation cells are arranged as one or more first deformation cells included on an upper wall delimiting a cavity of the flexible portion, wherein at least one first deformation cell is a through hole extending transversely through the upper wall.

2. The handle of claim 1, wherein the first flexible portion comprises a longitudinal tubular portion comprising the cavity that is delimited by the upper wall, a lower wall and two lateral walls, the upper wall being opposite to the lower wall, the two lateral walls being opposite to each other and connecting together the upper and the lower walls.

3. The handle of claim 2, wherein the one or more deformation cells are arranged as one or more second deformation cells included on the lower wall.

4. The handle of claim 3, wherein at least one second deformation cell is a blind hole opening within the cavity.

5. The handle of claim 3, wherein the first deformation cells and the second deformation cells are coaxial.

6. The handle of claim 2, wherein the tubular portion includes a transverse interior wall connecting at least the upper and the lower walls to each other.

7. The handle of claim 6, wherein the interior wall divides the cavity into two or more third deformation cells which extend transversally to a longitudinal axis of the handle, between the lateral walls of the first flexible portion.

8. The handle of claim 1, wherein the connection portion and/or the manipulation portion are made of a first material, and the first flexible portion comprises a second material, different from the first material.

9. The handle of claim 1, wherein the first flexible portion is configured to allow a bending movement of the connection portion relative to the manipulation portion about a first axis, and also a torsional movement of the connection portion relative to the manipulation portion about second axis, orthogonal to the first axis.

10. The handle of claim 1, further comprising a release portion comprising at least one second flexible portion arranged between the first flexible portion and an attachment point of the connection portion for attachment of the razor cartridge to the connection portion.

11. The handle of claim 10, wherein the connection portion is detachable from the razor cartridge by deflecting the at least one second flexible portion away from a rest position of the at least one second flexible portion.

12. The handle of claim 11, wherein the at least one second flexible portion comprises a living hinge connecting the attachment point to the first flexible portion and the at least one second flexible portion comprises an elastomeric element configured to bias the living hinge of the at least one second flexible portion towards the rest position.

13. A skincare device comprising the handle according to claim 1 and a razor cartridge configured to be removably or fixedly attached to the handle.

14. A process of manufacturing the handle according to claim 1, comprising providing the manipulation and connection portions, and fabricating the first flexible portion, wherein fabricating the first flexible portion includes additively-manufacturing at least the first flexible portion.

15. A handle for a shaver including a manipulation portion, a connection portion configured to connect to a razor cartridge, and a first flexible portion connecting the manipulation portion to the connection portion, the first flexible portion including one or more deformation cells of one or more predetermined shapes between the manipulation portion and the connection portion, wherein the one or more deformation cells are arranged as one or more second deformation cells included on a lower wall delimiting a cavity of the flexible portion, wherein the flexible portion comprises a longitudinal tubular portion comprising the cavity that is delimited by an upper wall, the lower wall and two lateral walls, the upper wall being opposite to the lower wall, the two lateral walls being opposite to each other and connecting together the upper and the lower walls, wherein at least one second deformation cell is a blind hole opening within the cavity.

16. The handle of claim 15, wherein the one or more deformation cells are arranged as one or more first deformation cells included on the upper wall.

17. The handle of claim 16, wherein the first deformation cells and the second deformation cells are coaxial.

18. A handle for a shaver comprising a manipulation portion, a connection portion configured to connect to a razor cartridge, and a flexible portion connecting the manipulation portion to the connection portion, the flexible portion including one or more deformation cells of one or more predetermined shapes between the manipulation portion and the connection portion, wherein the one or more deformation cells are arranged as one or more first deformation cells included on an upper wall, wherein the flexible portion comprises a cavity that is delimited by the upper wall and a lower wall, the upper wall being opposite to the lower wall, wherein the one or more deformation cells are arranged as one or more second deformation cells included on the lower wall, wherein at least one second deformation cell is a blind hole opening within the cavity.

19. The handle of claim 18, wherein the flexible portion comprises a longitudinal tubular portion comprising the cavity that is delimited by the upper wall, the lower wall, and two lateral walls, the two lateral walls being opposite to each other and connecting together the upper and the lower walls.

20. A skincare device comprising the handle according to claim 18 and a razor cartridge configured to be removably or fixedly attached to the handle.

* * * * *